US007681248B2

(12) United States Patent
Legenstein

(10) Patent No.: US 7,681,248 B2
(45) Date of Patent: Mar. 23, 2010

(54) ROLLING KNEE SUPPORT WITH DETACHABLE KNEE PAD

(75) Inventor: Mark P. Legenstein, Lancaster, PA (US)

(73) Assignee: Knee Blades LLC, Lancaster, PA (US)

( * ) Notice: Subject to any disclaimer, the term of this patent is extended or adjusted under 35 U.S.C. 154(b) by 694 days.

(21) Appl. No.: 11/269,364

(22) Filed: Nov. 8, 2005

(65) Prior Publication Data

US 2006/0277643 A1 Dec. 14, 2006

Related U.S. Application Data

(63) Continuation-in-part of application No. 11/138,610, filed on May 26, 2005, now abandoned.

(51) Int. Cl.

| | |
|---|---|
| ***A41D 13/00*** | (2006.01) |
| ***A41D 13/06*** | (2006.01) |
| ***A41D 27/12*** | (2006.01) |
| ***A63C 17/00*** | (2006.01) |

(52) U.S. Cl. ..... 2/24; 2/62; 280/11.19

(58) Field of Classification Search ..... 2/24, 2/23, 455, 62, 267, 911, 22; 280/32.5, 32.6, 280/87.01, 89; 297/423.1; 602/26

See application file for complete search history.

(56) References Cited

U.S. PATENT DOCUMENTS

| | | | | |
|---|---|---|---|---|
| 718,875 | A * | 1/1903 | Pettersen | 280/32.5 |
| 1,090,446 | A * | 3/1914 | Boynton | 2/24 |
| 1,296,622 | A | 3/1919 | Holsey | |
| 1,348,683 | A * | 8/1920 | Aldenbruck et al. | 280/32.5 |
| 1,382,883 | A | 6/1921 | Ashbridge | |
| 1,533,907 | A * | 4/1925 | Whipp | 2/24 |
| 1,547,166 | A * | 7/1925 | Davidson | 2/24 |
| 2,484,494 | A * | 10/1949 | Ferguson | 2/24 |
| 4,413,832 | A * | 11/1983 | Pendleton | 280/845 |
| 4,623,158 | A * | 11/1986 | Monreal | 280/11.12 |
| D353,702 | S | 12/1994 | Martinez et al. | D34/23 |

(Continued)

FOREIGN PATENT DOCUMENTS

| | | |
|---|---|---|
| WO | WO 99/51312 | 10/1999 |

(Continued)

OTHER PUBLICATIONS http://dictionary.reference.com/browse/latch; Dictionary.com; "latch"; p. 1; as of Nov. 26, 2007.*

(Continued)

*Primary Examiner*—Gary L Welch
*Assistant Examiner*—Amber R Anderson
(74) *Attorney, Agent, or Firm*—McNees Wallace & Nurick, LLC

(57) ABSTRACT

A rolling knee support comprises a base with a detachable knee pad. The base includes a knee pad receiving portion and roller attachment portions. Each of the roller attachment portions has a caster mounted thereto. The knee pad is detachably mounted to the knee pad receiving portion. A strap extends from the rolling knee support for attachment of the rolling knee support to a wearer's knee area. An outer cover may be placed on the knee pad when the knee pad is detached from the rolling knee support.

19 Claims, 7 Drawing Sheets

U.S. PATENT DOCUMENTS

| | | | | |
|---|---|---|---|---|
| 5,380,021 | A * | 1/1995 | Doherty | 280/32.5 |
| 5,537,689 | A * | 7/1996 | Dancyger | 2/24 |
| 5,725,224 | A * | 3/1998 | Kerr | 280/11.19 |
| 5,840,397 | A * | 11/1998 | Landi et al. | 428/73 |
| 5,870,774 | A * | 2/1999 | Legenstein | 2/24 |
| 5,924,140 | A * | 7/1999 | Chi | 2/455 |
| 5,937,440 | A * | 8/1999 | Ferriter | 2/24 |
| 5,979,939 | A * | 11/1999 | Siboni | 280/809 |
| 5,984,360 | A | 11/1999 | Edwards et al. | 280/845 |
| 6,219,845 | B1 * | 4/2001 | Ferriter | 2/24 |
| 6,302,413 | B1 * | 10/2001 | Comeaux | 280/32.5 |
| 6,347,403 | B1 * | 2/2002 | Wilcox | 2/23 |
| 6,510,560 | B1 * | 1/2003 | Ugolnik | 2/455 |
| 6,942,605 | B1 * | 9/2005 | Sukhovitsky | 482/132 |
| 7,018,351 | B1 * | 3/2006 | Iglesias et al. | 602/27 |
| 7,070,241 | B2 * | 7/2006 | Saulnier et al. | 297/423.12 |
| 7,197,770 | B1 * | 4/2007 | Warren | 2/24 |
| 7,213,819 | B2 * | 5/2007 | Carbonero | 280/79.11 |
| 2004/0108074 | A1 * | 6/2004 | Marchetti | 156/468 |
| 2004/0255356 | A1 * | 12/2004 | Lesosky | 2/24 |
| 2006/0237922 | A1 * | 10/2006 | Forbis | 280/32.6 |

FOREIGN PATENT DOCUMENTS

| | | |
|---|---|---|
| WO | WO 01/58542 A1 | 8/2001 |

OTHER PUBLICATIONS http://www.enotes.com/how-products-encyclopedia/felt; Felt: How Products Are Made; May 18, 2008; p. 1, para. 1.*

Austin's Knee Skates, website at www.pettemp.com/kneeskates, Mac Industries, printed Mar. 28, 2006, pp. 1-3.

PCT International Search Report dated Mar. 30, 2007 for International Application No. PCT/US2006/020853.

* cited by examiner

ROLLING KNEE SUPPORT WITH DETACHABLE KNEE PAD

CROSS-REFERENCE TO RELATED APPLICATIONS

This application is a continuation-in-part of U.S. patent application Ser. No. 11/138,610, filed May 26, 2005 now abandoned.

FIELD OF THE INVENTION

The invention generally relates to a rolling knee support and, more particularly, relates to a rolling knee support having a detachable knee pad with an outer cover.

BACKGROUND OF THE INVENTION

Knee pads are designed to cushion and protect a wearer's knee area when the wearer is kneeling on a support surface. Some types of knee pads comprise only a cushion to protect the wearer's knee area while other types of knee pads comprise a cushion that directly or indirectly contacts the wearer's knee area and a shell that contacts the support surface. Still other types of knee pads have a base to facilitate rolling the knee pad along the support surface. These rolling knee supports are designed to protect the wearer's knee area while also providing the wearer with a degree of mobility while the wearer is kneeling. The rolling knee support is attached to the wearer's knee area so that wearer is able to rise and kneel back upon the rolling knee support without having to re-adjust its orientation.

In conventional rolling knee supports, the knee pad is permanently attached to the base. Because the knee pad is permanently attached to the base, the entire rolling knee support must be replaced if the base and/or the knee pad becomes worn or damaged. It would therefore be desirable to develop a rolling knee support where the knee pad is quickly and easily detachable from the base so that either the base or the knee pad may be replaced without having to dispose of the remainder of the rolling knee support. It would further be desirable to develop a rolling knee support where the knee pad can be used separate from the rolling knee support. It would still further be desirable for the knee pad to have an outer cover that enhances the degree of mobility of the wearer when the wearer is kneeling and moving about the support surface.

SUMMARY OF THE INVENTION

The invention provides for a rolling knee support comprising a base including a knee pad receiving portion and roller attachment portions. Each of the roller attachment portions has a caster mounted thereto. A knee pad is detachably mounted to the knee pad receiving portion. A strap extends from the rolling knee support for attachment of the rolling knee support to a wearer's knee area.

The invention further provides for a knee pad comprising a shell having a top surface and a bottom surface. A cushion is attached to a top surface of the shell. A strap extends from the shell for attaching the knee pad to a wearer's knee.

The invention still further provides for a removeable outer cover for a knee pad having a substantially rigid shell and a cushion. The outer cover comprises a sheet of material having edges gathered to form an opening. The opening substantially corresponds to the shell of the knee pad. The edges of the opening are capable of stretching when the knee pad is inserted therein.

DETAILED DESCRIPTION OF THE INVENTION

Figure 1:
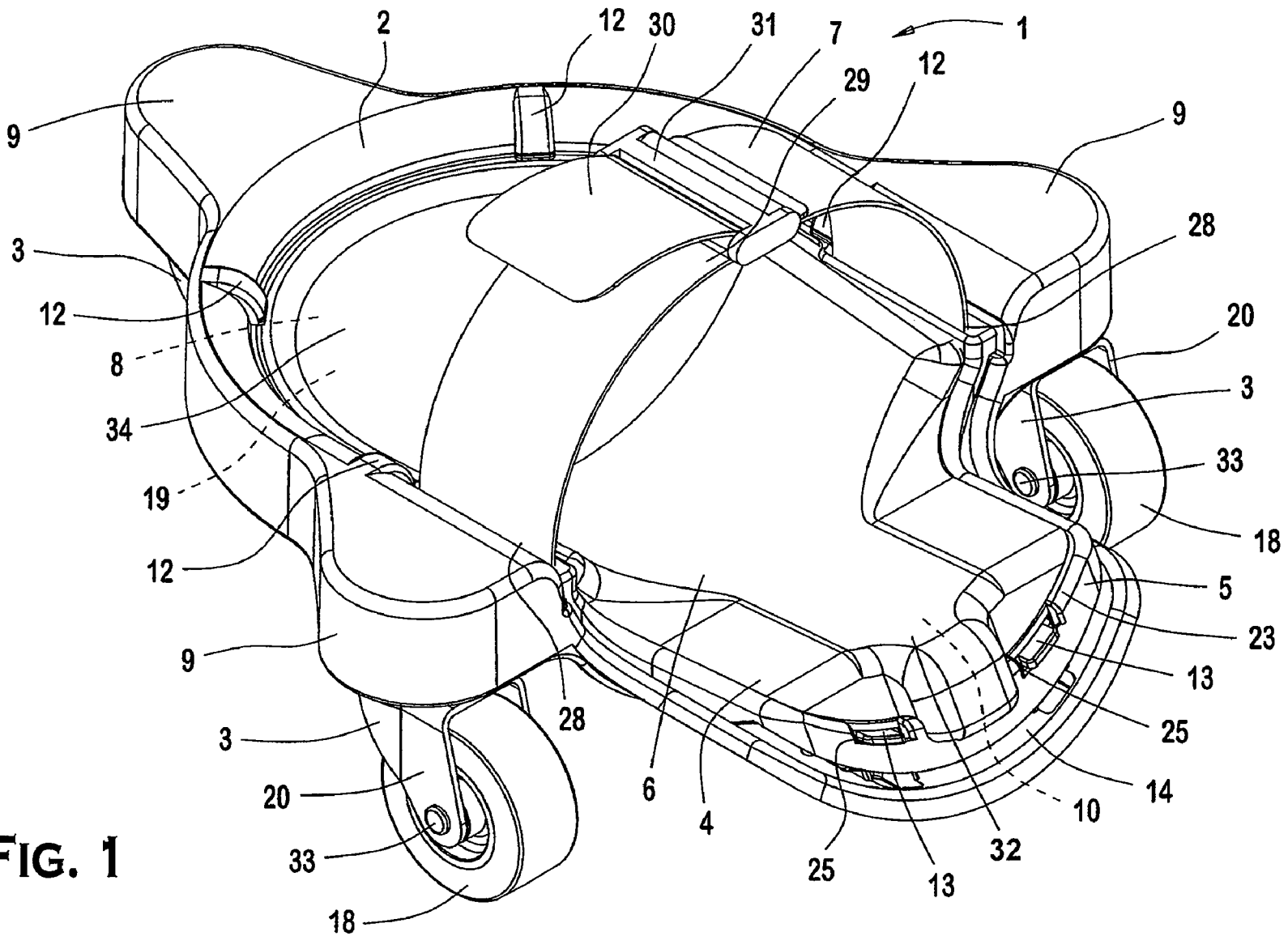
FIG. 1 is a perspective view of a rolling knee support according to the invention.
Figure 2:
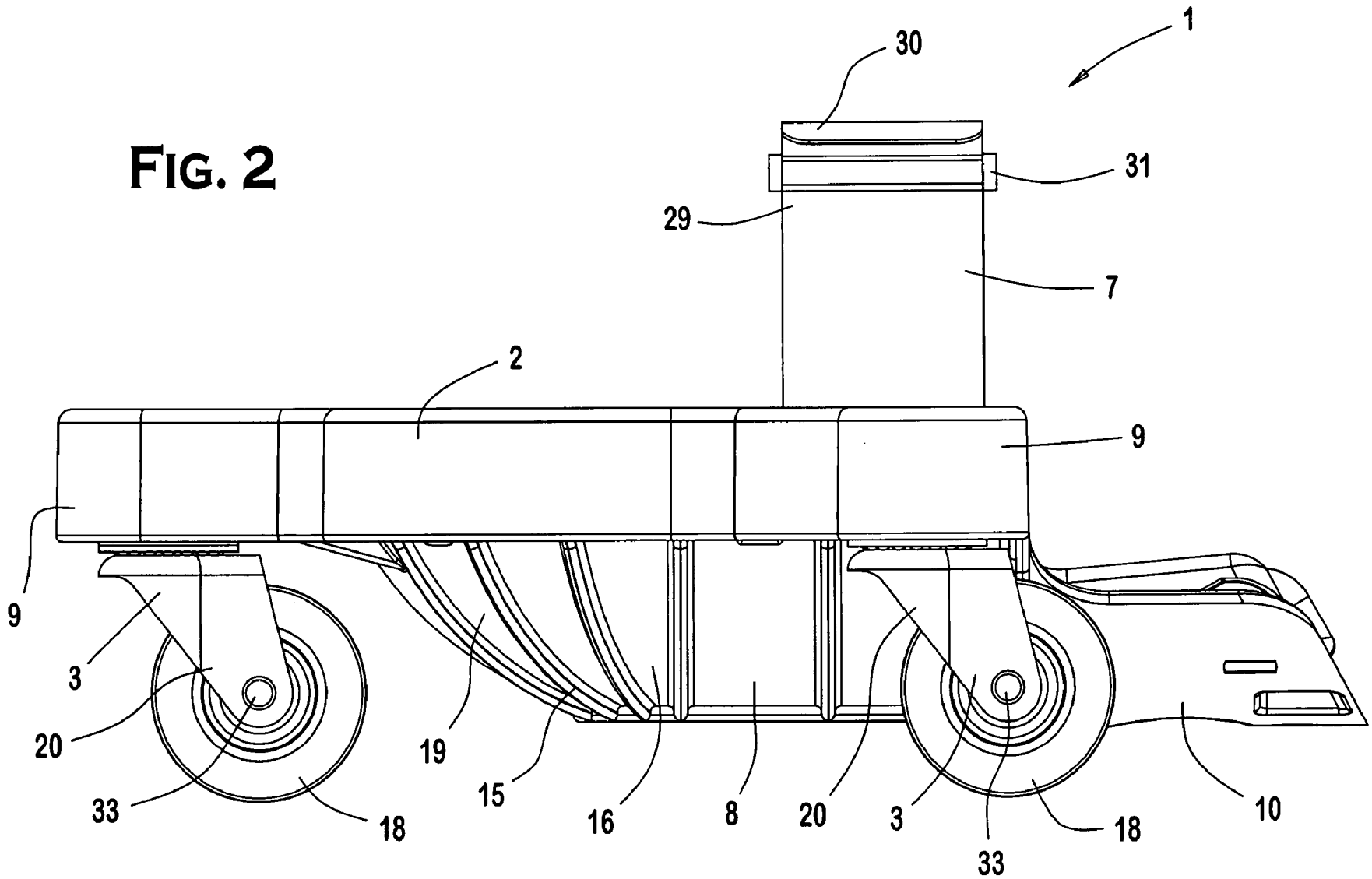
FIG. 2 is a side view of the rolling knee support.
Figure 3:
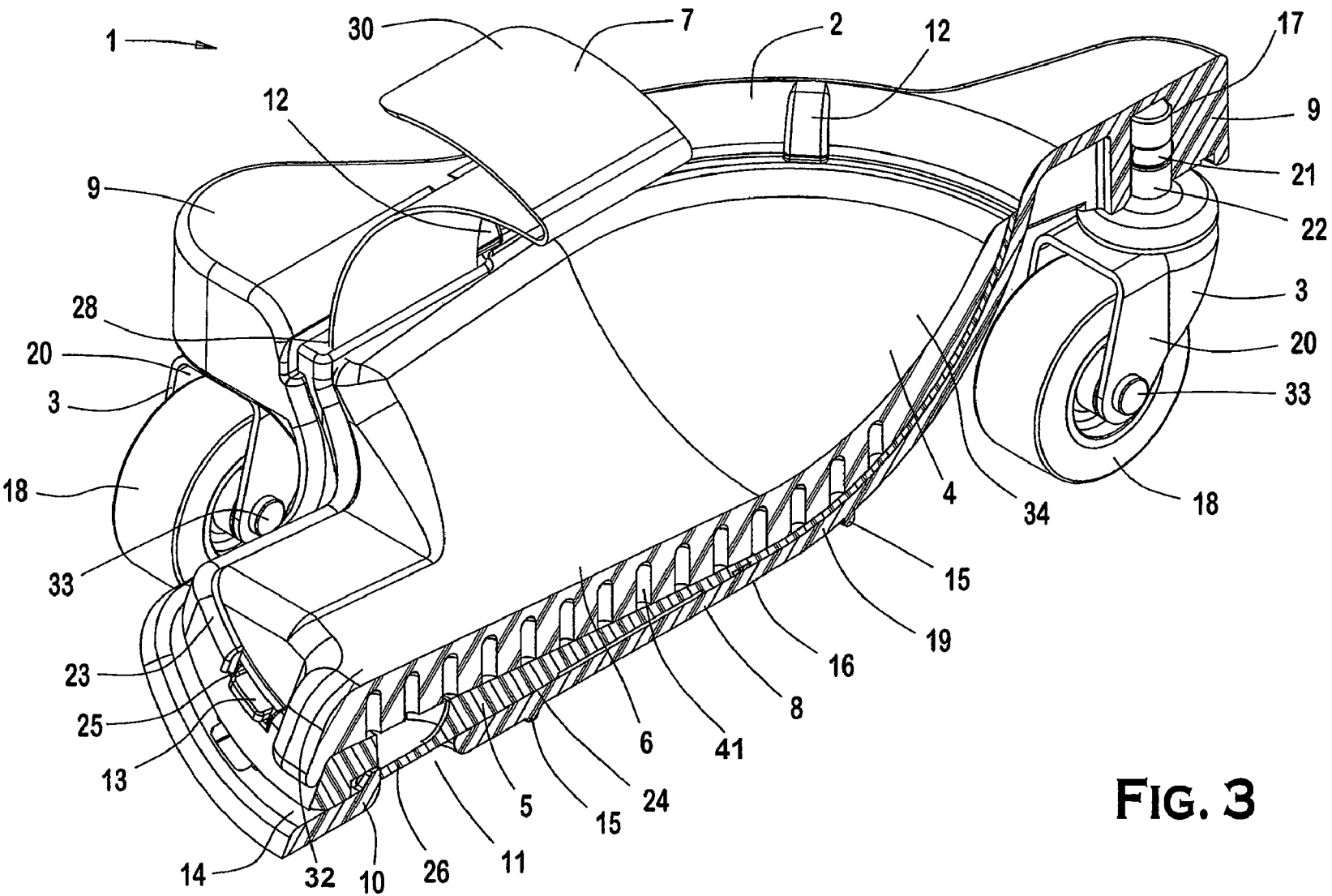
FIG. 3 is a partial sectional view of the rolling knee support.

FIGS. 1-3 show a rolling knee support 1 according to the invention. As shown in FIG. 1, the rolling knee support 1 comprises a base 2 with a plurality of casters 3. A knee pad 4 is detachably mounted to the base 2. The knee pad 4 comprises a shell 5 and a cushion 6. A strap 7 is attached to the shell 5. The rolling knee support 1 is secured to a wearer's knee area by the strap 7.

Each of the individual elements of the rolling knee pad 1 will now be described in greater detail. As shown in FIGS. 1-3, the base 2 includes a knee pad receiving portion 8 and roller attachment members 9. The knee pad receiving portion 8 is substantially concave in shape and consists of a knee support area 19 and a shin support area 10. The shin support area 10 extends from the knee support area 19 and has a release aperture 11 formed therein, as best shown in FIG. 3. It will be appreciated by those skilled in the art that the knee pad receiving portion 8 may alternatively be formed without the shin support area 10.

As shown in FIG. 1, first and second latching projections 12, 13, respectively, extend from an inner surface 14 of the base 2. The first latching projections 12 extend toward the knee support area 19 and are positioned adjacent thereto. The second latching projections 13 extend from the shin support area 9. It will be appreciated by those skilled in the art that the first and second latching projections 12, 13 may alternatively be arranged at other positions on the knee pad receiving portion 8. Additionally, it will be appreciated by those skilled in the art that other attachment mechanisms may be used. As shown in FIG. 2, base support ribs 15 are formed on an outer surface 16 of the base 2. Although the base support ribs 15 are only shown as being formed on the knee pad receiving portion 8, it will be appreciated by those skilled in the art that the base support ribs 15 may be formed anywhere on the base 2 to provide additional support for the base 2.

As shown in FIG. 1, the roller attachment members 9 extend from the knee pad receiving portion 8. In the illustrated embodiment, the base 2 has three of the roller attachment members 9 arranged in a substantially triangular shape for adequate mobility and balance. Although the base 2 is shown as having three of the roller attachment members 9 in the illustrated embodiment, it will be appreciated by those skilled in the art that the base 2 could alternatively have any number of the roller attachment members 9 arranged in various positions. As shown in FIG. 3, each of the roller attachment members 9 has a slot 17 extending from the outer surface 16 of the base 2 toward the inner surface 14.

The base 2 may be formed, for example, by molding a plastic material, such as polycarbonate. Alternatively, the base 2 may be made, for example, from metal or wood. Although in the illustrated embodiment the knee pad receiving portion 8 and the roller attachment members 9 are integrally formed from a single piece of material, it will be appreciated by those in the art that the knee pad receiving portion 8 and the roller attachment members 9 may be formed separately.

As shown in FIG. 2, each of the casters 3 consist of a roller 18 mounted on an axle 33. The axle 33 is mounted to a housing 20 such that the roller 18 is free to rotate therein. A support pin 21 extends from the housing 20, as shown in FIG. 3. The support pin 21 is rotationally mounted in a support shaft 22 such that the roller 18 is capable of moving in any direction. The support shaft 22 may be press-fit or otherwise mounted in the slot 17 of the wheel attachment member 9. Although the casters 3 are described as having a specific structure herein, it will be appreciated by those skilled in the art that casters are well known in the art and that other structures are possible and may be substituted for the structure described herein.

Figure 4:
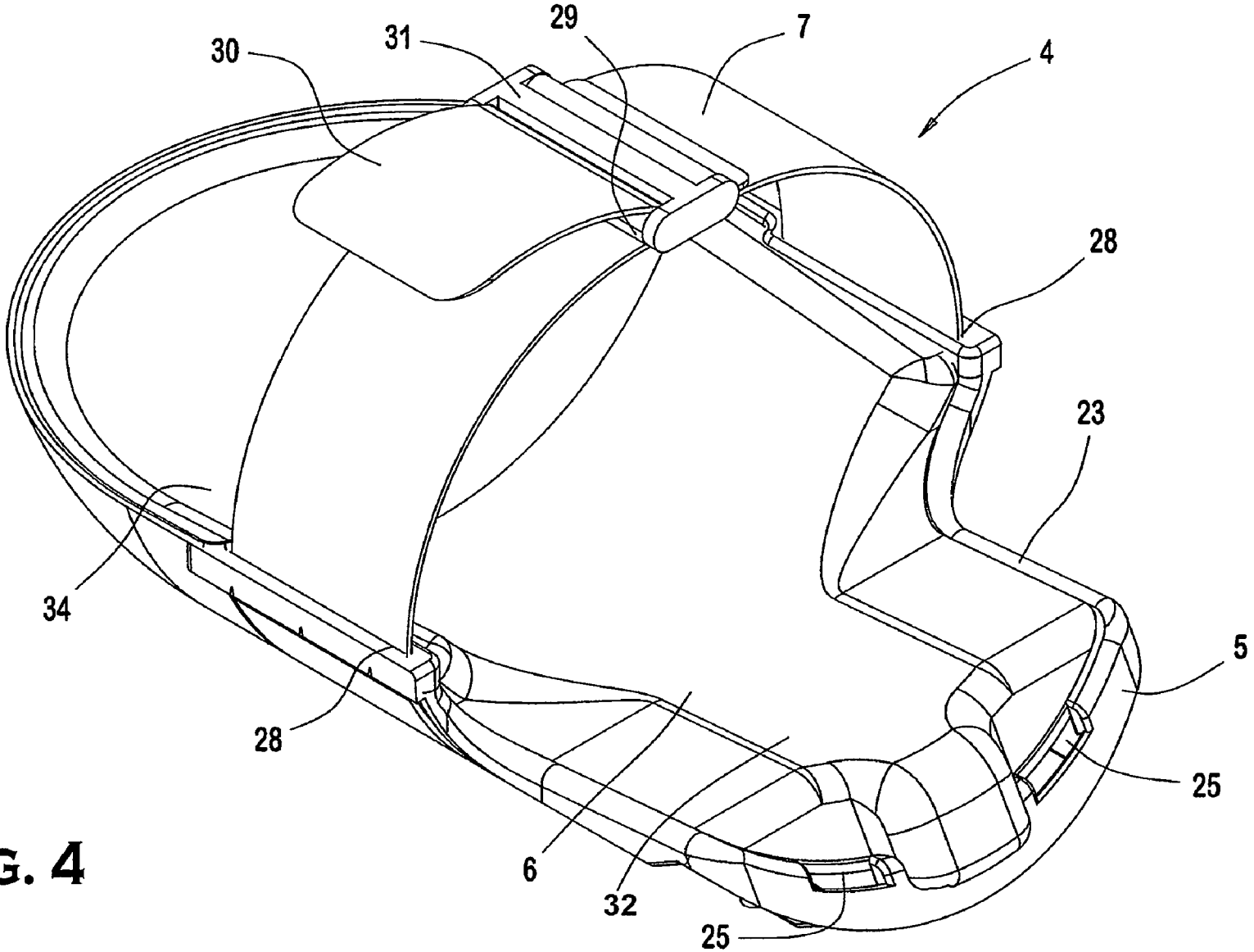
FIG. 4 is a top perspective view of a knee pad.
Figure 5:
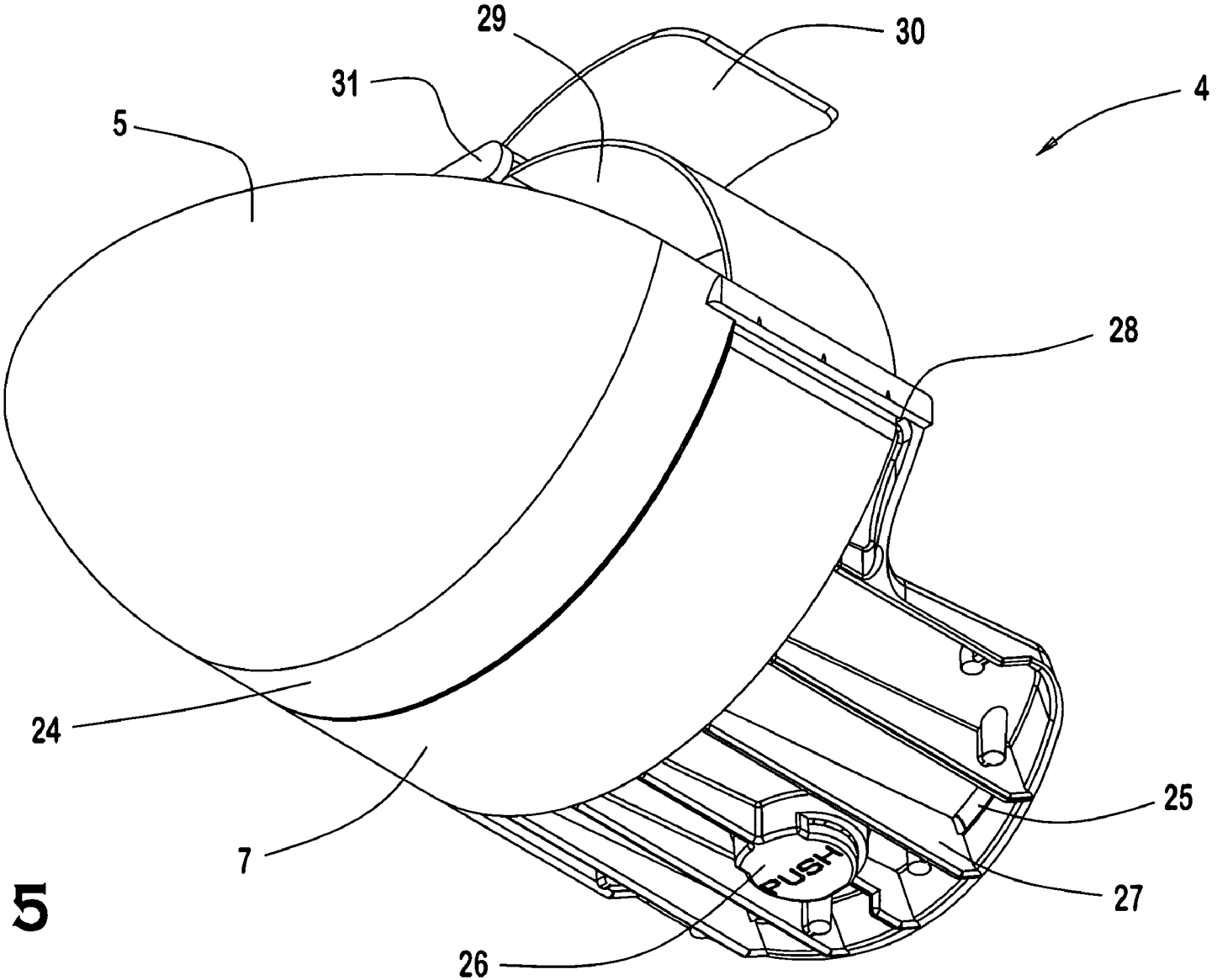
FIG. 5 is a bottom perspective view of the knee pad.

FIGS. 4-5 show the knee pad 4. As shown in FIGS. 4-5, the shell 5 of the knee pad 4 substantially corresponds to the knee pad receiving portion 8 of the base 2. The shell 5 has a top surface 23 and a bottom surface 24. As shown in FIG. 4, the shell 5 has latching projection receiving apertures 25 corresponding to the second latching projections 13 of the base 2. As shown in FIG. 5, a release member 26 that corresponds to the release aperture 11 of the base 2 extends from the bottom surface 24 of the shell 5. Shell support ribs 27 are formed adjacent to the release member 26. Although the shell support ribs 27 are only shown as being formed only on a portion of the shell 5, it will be appreciated by those skilled in the art that the shell support ribs 27 may be formed anywhere on the shell 5 to provide additional support for the shell 5. Strap receiving openings 28 are formed on opposite sides of the shell 5. The shell 5 may be made, for example, from a plastic material, such as polypropylene. Alternatively, the shell 5 may be made, for example, from leather, cloth, or rubber.

As shown in FIG. 4, the cushion 6 is provided on the top surface 23 of the shell 5. The cushion 6 has a knee receiving area 34 and a shin receiving area 32. The cushion 6 has a plurality of cavities 41 that extend from a bottom of the cushion toward the knee receiving area 34 and shin receiving area 32, as shown in FIG. 3. The cushion 6 may be formed, for example, from a foam material, such as santoprene or foam polystyrene. Alternatively, the cushion 6 may be formed, for example, from an air pad, a gel pack, or any other known cushioning material. The cushion 6 may be attached to the shell 5 by an adhesive (not shown) or any other known attachment method. Although the cushion 6 is shown as covering substantially all of the shell 5, it will be appreciated by those skilled in the art that the cushion 6 could alternatively cover only a portion of the shell 5.

As shown in FIG. 5, the strap 7 extends around the bottom surface 24 of the shell 5. The strap 7 extends through the strap receiving openings 28, so that the strap 7 is secured to the shell 5. As shown in FIG. 4, the strap 7 has first and second ends 29, 30, respectively. The first end 29 is secured to a fastening member 31. The second end 30 passes through the fastening member 31 such that the strap 7 may be adjusted to a desired tightness. Although in the illustrated embodiment the fastening member 31 is shown as a buckle, it will be appreciated by those skilled in the art that other types of conventional fastening members may be used. The strap 7 may also be formed without a fastening member and/or formed to be un-adjustable. Additionally, although only one strap is shown in the illustrated embodiment, it will be appreciated by those skilled in the art that multiple straps may be used.

Figure 6:
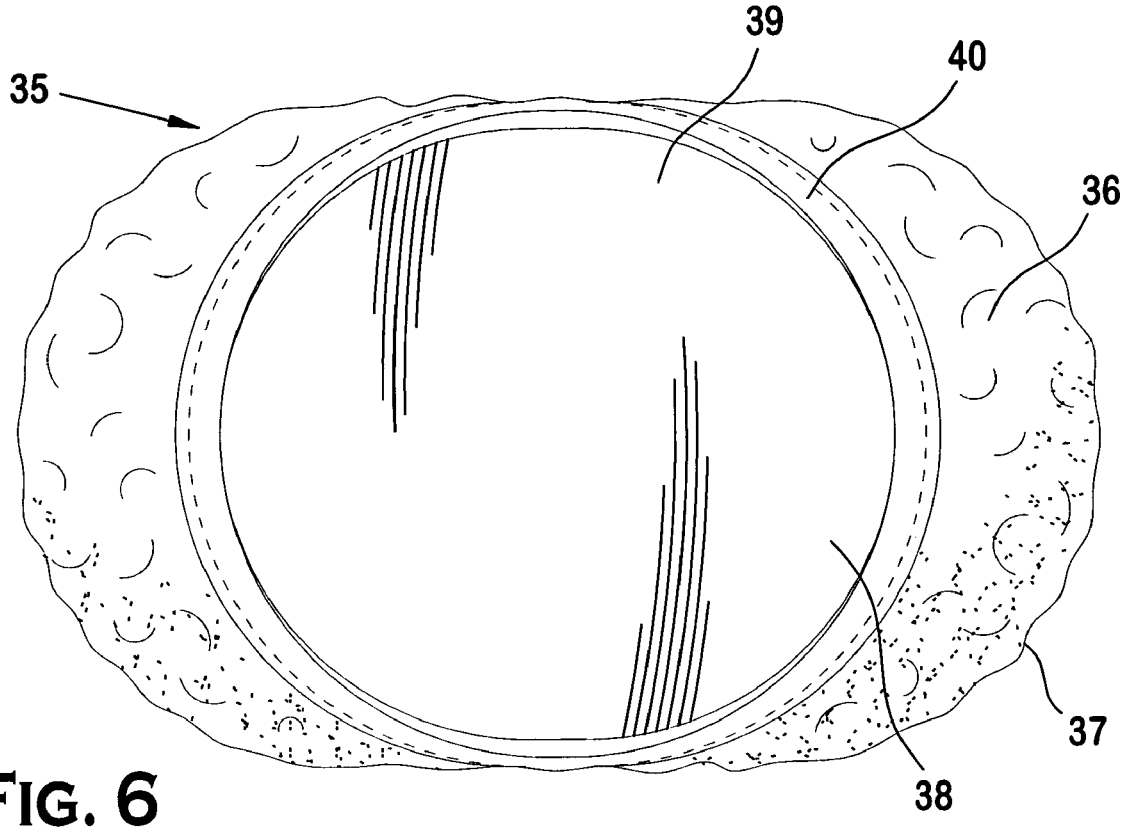
FIG. 6 is a top view of an outer cover.
Figure 7:
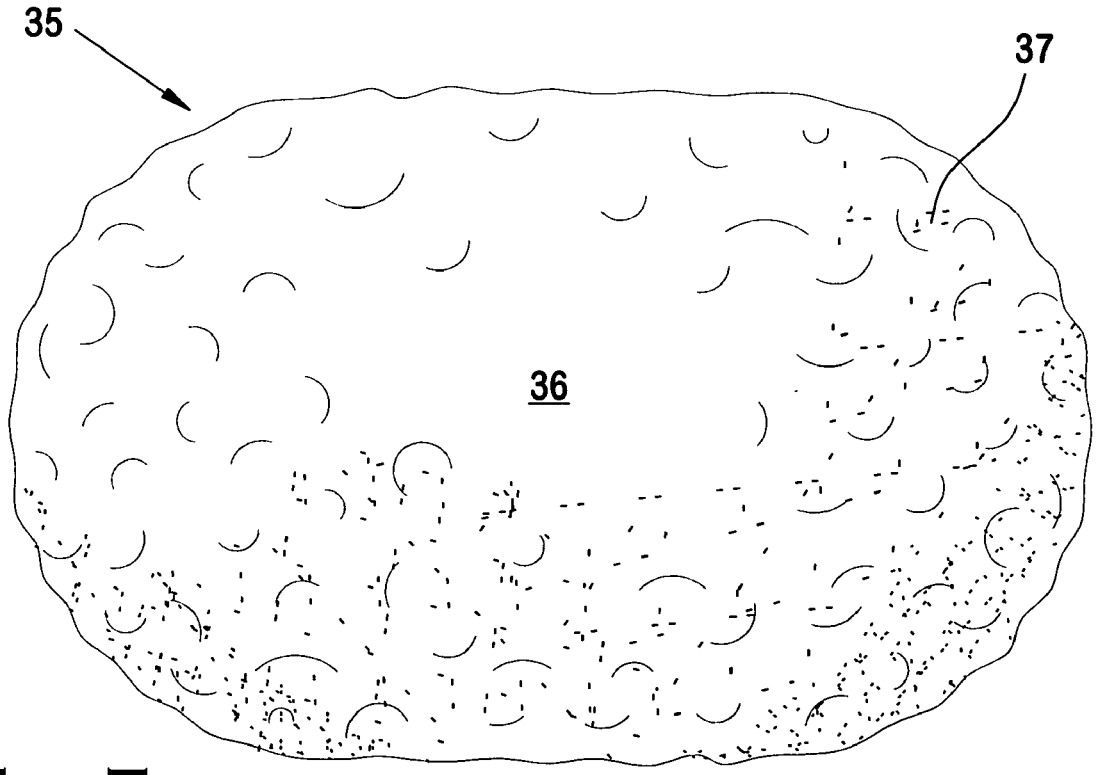
FIG. 7 is a bottom view of an outer cover.
Figure 8:
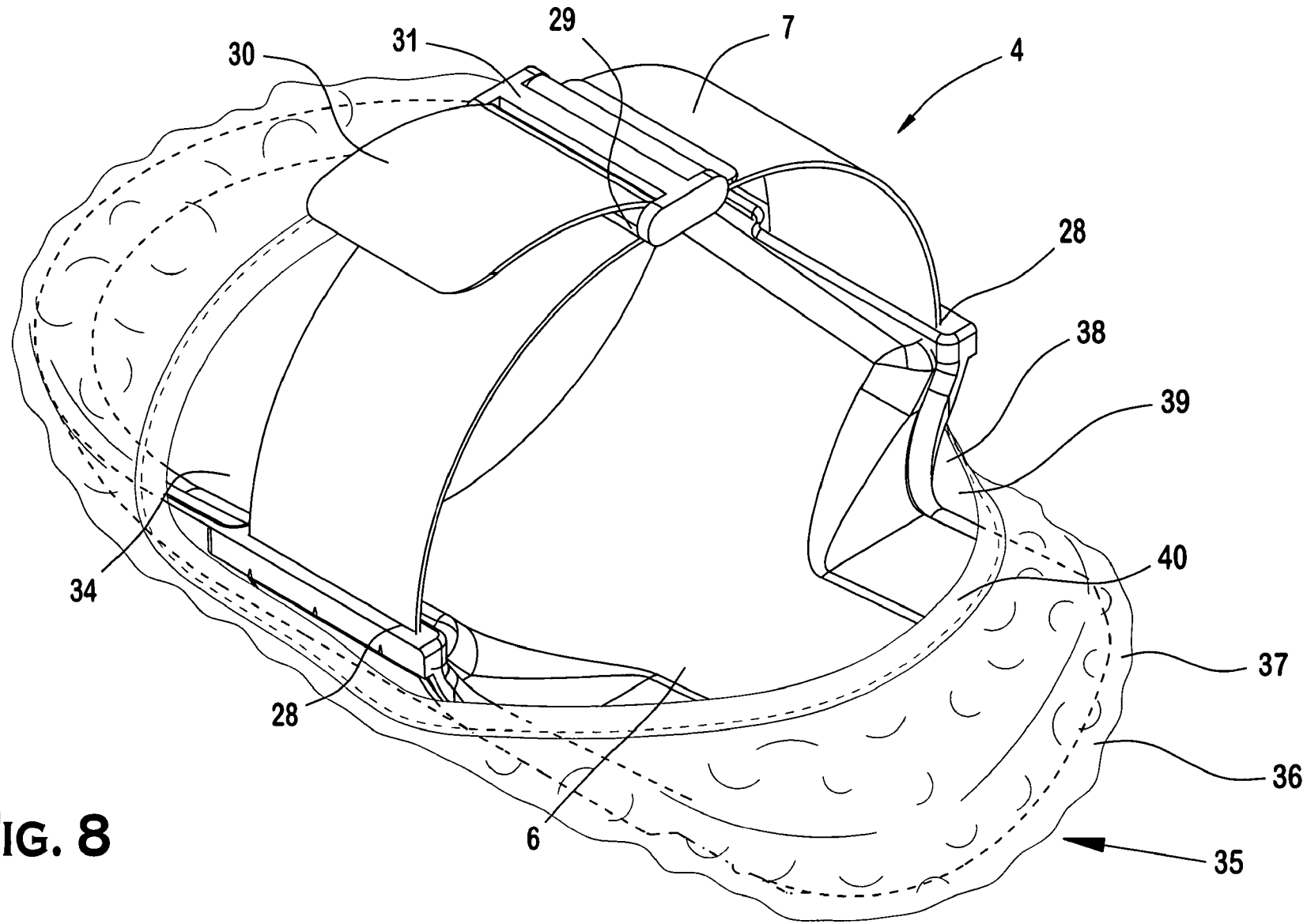
FIG. 8 is a top perspective view of the knee pad provided with the outer cover.

FIGS. 6-8, show an outer cover 35 for the knee pad 4. As shown in FIGS. 6-7, the outer cover 35 is formed from a sheet of material 36 having an outside surface 37 and an inside surface 38. The outside surface 37 of the material 36 may be, for example, relatively soft and/or fuzzy and is capable of readily sliding on a support surface. The material 36 may be formed for, example, from polyester, cotton, nylon, etc. Edges of the material 36 are gathered to form an opening 39. The opening 39 substantially corresponds to the size and shape of the knee pad 4. The edges forming the opening 39 may be drawn together with a cord or elastic member 40 so that the opening 39 is capable of stretching when the knee pad 4 is inserted therein, as described later.

To assemble the rolling knee support 1, the bottom surface 24 of the shell 5 is positioned adjacent to the inner surface 14 of the base 2 such that the shell 5 aligns with the knee pad receiving portion 8. The shell 5 is pressed into contact with the base 2 so that the release member 26 is received in the release aperture 11, the second latching projections 13 are received in the latching projection receiving apertures 25, and the top surface 23 of the shell 5 is received under the first latching projections 12. The knee pad 4 is thereby secured to the base 2 by the first and second latching projections 12, 13.

To detach the knee pad 4 from the base 2, the release member 26 extending through the outer surface 16 of the base 2 is pressed back through the release aperture 11 such that the shell 5 disengages from the first and second latching projections 12, 13. Because the knee pad 4 is detachable from the base 2, the knee pad 4 may easily be replaced if the knee pad 4 becomes damaged or worn. Likewise, the base 2 may be replaced if the base 2 becomes damaged or worn without having to dispose of the knee pad 4.

In use, a wearer places the cushion 6 of the knee pad 4 adjacent to or against their knee area. The wearer secures the strap 7 to their knee area by inserting the second end 30 of the strap 7 through the fastening member 31 and adjusting the second end 30 of the strap 7 until the cushion 6 securely rests against their knee area. The wearer is then capable of standing or kneeling with the rolling knee pad 1 securely attached to their knee area. When the wearer is kneeling on a support surface, the rolling knee support 1 protects the wearer's knee area and enables the wearer to easily move about the support surface in any desired direction. The rolling knee support 1 may be used, for example, to protect the wearer's knee area when performing such functions as laying flooring, playing sports, etc. Additionally, the cavities 41 in the cushion 6 provide additional comfort and support for the wearer's knee area.

It will be appreciated by those skilled in the art that the knee pad 4 may also be used without the base 2. When the knee pad 4 is used without the base 2, the knee pad 4 is attached to the wearer's knee area in substantially the same manner as when the rolling knee support 1 is attached thereto. The wearer is then capable of standing or kneeling with the knee pad 4 securely attached to their knee area. When the wearer is kneeling on the support surface, the knee pad 4 protects the wearer's knee area. Additionally, the outer cover 35 may be applied to the knee pad 4, as shown in FIG. 8. The outer cover 35 is applied to the knee pad 4 by inserting the knee pad 4 into the stretchable opening 39 so that the inside surface 38 is positioned against the shell 5. The outer cover 35 thereby enhances the degree of mobility of the wearer when the wearer is kneeling and moving about the support surface.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A rolling knee support, comprising:

a base including a substantially concave knee pad receiving portion and roller attachment portions, each of the roller attachment portions having a caster mounted thereto;

a knee pad including a shell and a cushion, the shell supporting the cushion on the knee pad receiving portion;

at least first and second latching projections extending from the base that engage the shell at a periphery thereof that detachably mounts the knee pad to the knee pad receiving portion, the second latching projection engages in a corresponding latching projection receiving aperture in the shell;

the knee pad including a release member for detaching the knee pad from the knee pad receiving portion; and a strap extending from the rolling knee support for attachment of the rolling knee support to a wearer's knee area.

2. The rolling knee support of claim 1, wherein the strap extends around a bottom surface of the shell and is attached thereto.

3. The rolling knee support of claim 1, wherein the cushion includes a knee receiving area and a shin receiving area.

4. The rolling knee support of claim 1, wherein the cushion includes a plurality of cavities.

5. The rolling knee support of claim 1, wherein the cushion substantially covers the shell.

6. The rolling knee support of claim 1, wherein the shell includes shell support ribs.

7. The rolling knee support of claim 1, wherein the base is molded from a plastic material.

8. The rolling knee support of claim 1, wherein the knee pad receiving portion includes a knee support area and a shin support area.

9. The rolling knee support of claim 1, wherein the base includes a base support ribs.

10. The rolling knee support of claim 1, wherein the knee pad receiving portion and the roller attachment portions are formed from a single piece of material.

11. The rolling knee support of claim 1, wherein the castors are arranged in a substantially triangular shape.

12. The rolling knee support of claim 1, wherein the shell is formed from a substantially rigid material.

13. The rolling knee support of claim 12, wherein the shell is molded from a plastic material.

14. The rolling knee support of claim 1, wherein at least the first latching projection abuts a top surface of the shell.

15. A rolling knee support, comprising:

a base including a substantially concave knee pad receiving portion and roller attachment portions, each of the roller attachment portions having a caster mounted thereto;

a knee pad including a shell and a cushion, the shell supporting the cushion on the knee pad receiving portion;

at least first and second latching projections extending from the base that engage the shell at a periphery thereof that detachably mounts the knee pad to the knee pad receiving portion, the first latching projection abuts a top surface of the shell;

the knee pad including a release member for detaching the knee pad from the knee pad receiving portion; and a strap extending from the rolling knee support for attachment of the rolling knee support to a wearer's knee area.

16. The rolling knee support of claim 15, wherein the strap extends around a bottom surface of the shell and is attached thereto.

17. The rolling knee support of claim 15, wherein the cushion includes a knee receiving area and a shin receiving area.

18. The rolling knee support of claim 15, wherein the cushion substantially covers the shell.

19. The rolling knee support of claim 15, wherein the shell includes shell support ribs.

* * * * *